US005920964A

United States Patent [19]

Malzahn

[11] Patent Number: 5,920,964

[45] Date of Patent: Jul. 13, 1999

[54] FLEXIBLE REMOVABLE BELT LOOP

[76] Inventor: Karen L. Malzahn, 14209 Whispering Valley Dr., Cypress, Tex. 77429

[21] Appl. No.: 09/024,644

[22] Filed: Feb. 17, 1998

[51] Int. Cl.[6] ..... A44B 11/00

[52] U.S. Cl. ..... 24/182; 24/17 B; 24/163 K; 24/442

[58] Field of Search ..... 24/182, 183, 306, 24/17 B, 16 R, 442, 370, 600.9, 58, 763 K

[56] References Cited

U.S. PATENT DOCUMENTS

| | | | |
|---|---|---|---|
| 0,223,761 | 1/1880 | Rosencrans | 24/18 |
| 0,292,053 | 1/1884 | Richeson | 24/182 |
| 0,374,068 | 11/1887 | Hickle | 24/182 |
| 0,660,544 | 10/1900 | Gelabert | 24/306 |
| 1,495,925 | 5/1924 | Quetermous . | |
| 2,641,812 | 6/1953 | Boudreau | 24/182 |
| 2,686,920 | 8/1954 | Meeker | 24/182 |
| 3,279,008 | 10/1966 | Wallach . | |
| 3,866,276 | 2/1975 | Perkins . | |
| 4,819,303 | 4/1989 | Udelhofen . | |
| 4,858,249 | 8/1989 | Stewart | 24/442 |
| 5,077,867 | 1/1992 | Messina . | |
| 5,215,333 | 6/1993 | Knight . | |
| 5,251,361 | 10/1993 | Owens et al. . | |
| 5,441,188 | 8/1995 | Rosenstein | 24/13 |
| 5,458,267 | 10/1995 | Curtis et al. . | |
| 5,638,581 | 6/1997 | Burke | 24/306 |

FOREIGN PATENT DOCUMENTS

| | | | |
|---|---|---|---|
| 0491399 | 3/1954 | Italy | 24/182 |

*Primary Examiner*—Victor N. Sakran
*Attorney, Agent, or Firm*—Tobor, Goldstein, Healey, L.L.P.

[57] ABSTRACT

An adjustable belt loop which is easily removable and made of flexible material which enables one to secure the free end of a belt to the main portion of the belt which thereby prevents the sagging or protruding of a garment or accessory belt end. The adjustable belt loop comprises a strip of material, and optionally a display member, and is extended and folded over and onto the free belt end and the main portion of the belt. The first and second ends of the flexible strip overlap and are securably closed by the attachment means. Alternatively, the first end of the flexible strip may be removably attached to the second end of the flexible strip by attachment means without overlap.

11 Claims, 2 Drawing Sheets

FLEXIBLE REMOVABLE BELT LOOP

BACKGROUND OF THE INVENTION

1. Field of the Invention

This invention relates broadly to a device for securing the free end of a belt that hangs on or protrudes from the clothing, whether the belt is secured by a belt loop, by cloth or string loops, or if the belt is unsecured by any belt loops. The invention is functional and easily secures a belt end of any width or composition to the main portion of the belt in an appealing and decorative manner.

2. Description of Related Art

Others have attempted to address the problem of an imperfectly sized belt. The devices have varied in appearance, operation and utility, and none have been capable of solving the problem addressed by the present invention in such a novel and refreshing manner. Many of these devices were not adjustable for belt width and were bulky and unattractive. Others were not easily removable Accordingly, there is a longstanding need for a belt accessory that is functional, easily used, and fashionable. A device of the invention can be made from material which matches the belt or garment or a different type of material, and by design, is adjustable to accommodate for different belt widths. This device is meant to apply to garment belts worn by men and women, and is especially useful for women's belts since they often provide only a single belt loop to secure the belt end.

SUMMARY OF INVENTION

In a broad aspect, the invention is directed to an apparatus for securing the free end of a belt to the main portion of the belt. In a specific aspect, the apparatus includes an adjustable belt loop for securing the free end of a belt to the main portion of the belt. The belt loop is easily removable and includes: (a) an elongated main flexible strip having an inner surface with at least one connecting portion, an outer surface with at least one connecting portion, a first end and a second end; and (b) means for removably attaching the first end to the second end to form a loop around the main portion of the belt and the free end of the belt where the connecting portion of the outer surface and the connecting portion of the inner surface of the flexible strip are disposed in removable contact with each other to accomplish the attachment and to form the belt loop.

In another specific embodiment, the invention is directed to a garment belt, including: a main portion, an easily removable adjustable belt loop including: (a) an elongated main flexible strip having an inner surface with a connecting portion, an outer surface with a connecting portion, a first end and a second end, (b) means for removably attaching the first end to the second end to form a loop around the main portion of the belt and the free end of the belt wherein the connecting portion of the outer surface and the connecting portion of the inner surface of the flexible strip are disposed in removable contact with each other to accomplish the attachment and to form the belt loop, and (c) a display member having a supporting member which is connected to the outer surface of the elongated main flexible strip between the first end and the second end.

Another specific embodiment of the invention relates to an adjustable belt loop which secures the free end of a belt to the main portion of the belt, which belt loop is easily removable and includes: (a) an elongated main flexible strip having a first end and a second end, (b) means for attaching the first end of the flexible strip to the second end to form a loop around the main portion and the free end of the belt wherein the first end and the second end are disposed in removable contact with each other to accomplish the attachment and to form the belt loop, and (c) a display member having an inner supporting member, an outer supporting member, and at least one side member connecting the inner and outer supporting members wherein the elongated main flexible strip is disposed between the inner and outer supporting members.

The adjustable belt loops may have varying structures and features. In one specific embodiment, the adjustable belt loop includes means for attaching the first end to the second end which constitutes a series of corresponding snaps. In contrast, another specific embodiment of an adjustable belt loop has means for attaching the first end to the second end which includes a series of corresponding hook and loop fasteners. These means for attaching the first end to the second end may be used in conjunction with the other attachment means discussed herein. Also, these means for attachment may also be used alone or in conjunction with the other attachment means used for connecting the portion of the outer surface to the inner surface of the flexible strip.

Another specific embodiment of the adjustable belt loop has outer and inner surfaces that are reversible and have a connecting portion on both the first end and second end. The adjustable belt loop with reversible outer and inner surfaces can also have connecting portions on both sides of the inner surface and outer surface.

The garment belt loops also can include a display member that is integral with the elongated flexible strip. Conversely, another embodiment of the garment belt loop has a display member that is removable and interchangeable with another display member.

A specific embodiment of the garment belt loop has a display member with an attachment for releasably securing additional display members that are interchangeable. Yet another embodiment of the garment belt loop includes a display member that is tubular and slides onto the flexible strip.

The garment belt loop display member may also be permanently sewn onto the flexible strip. Conversely, the garment belt loop display member can have a back surface which is removably attachable to the flexible strip.

Another embodiment of the garment belt loop has a display member that has a front support portion which is removably attachable to the flexible strip by puncturing the flexible strip and attaching to a support member on the inner surface side of the flexible strip.

Also, the garment belt loop display member may be attached to a semi-rigid material which is removably clipped onto the flexible strip.

The garment belt loop display member may be made of various materials. In one specific embodiment, the display member is made of a rigid material. In contrast, in another specific embodiment, the display member is made of a flexible material.

DETAILED DESCRIPTION OF INVENTION

As mentioned above, the invention is preferably directed to a removable belt loop for securing belt ends. I will now describe specific embodiments, examples and versions of the invention, for the purpose of enabling others skilled in the art to make and use my invention. It is understood, however, that the invention is not limited to these specific embodiments, examples and versions. A person skilled in the art who has read this patent or seen the invention being used, described, or implemented will recognize many variations of the invention that might not be expressed here. Thus, it is the claims below that should be referred to for purposes of determining the scope of the invention, not only the literal elements therein, but also their substantial equivalents, including elements known to be interchangeable.

Figure 1:
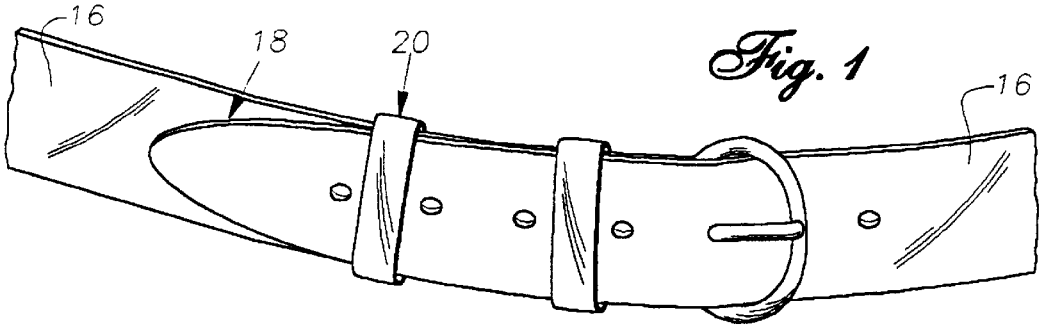
FIG. 1 is a front view of the additional removable belt loop employed on a garment belt.

In one aspect, the present invention is directed to an adjustable belt loop which can be securably attached to a belt as an original or additional loop and is adjustable and easily removable. As exemplified by the drawings, and in particular FIG. 1, a removable, adjustable, flexible belt loop in accordance with the present invention is designated by the reference numeral 20 in the closed state. When the removable belt loop is strategically placed, it secures the free end of the belt to the main portion of the belt. The added belt loop holds the free end of the belt 18 close to the main portion of the belt 16 which in one aspect facilitates a tidy appearance. The adjustable belt loop is in the form of an elongated main flexible strip having an inner surface, an outer surface, a first end, and a second end. As used herein, the term "flexible" means that the strip is sufficiently flexible so that the strip can encircle the main portion of the belt and the belt end. The strip can be made from a variety of flexible materials such as cloth, leather, and plastic. It is the strip as a whole that must be flexible. If only part of the strip is made of flexible material, the portions of the main strip which are bent around and onto the belt and belt end is flexible. For example, the flexible strip can be made of rigid segments or components.

A multi-layered strip can be used. If lightweight materials such as silk are used, the flexible strip may have a reinforcing means on its inner surface to give the belt loop a more rigid character. The reinforcing means may be plastic, mesh, or other commercially available materials that are used to give fabric body or make the fabric somewhat stiff Where a lightweight material is used for a strip that is reversible, a separate reinforcing strip may be located between the two strips of material that are joined to form the flexible strip.

Figure 2:
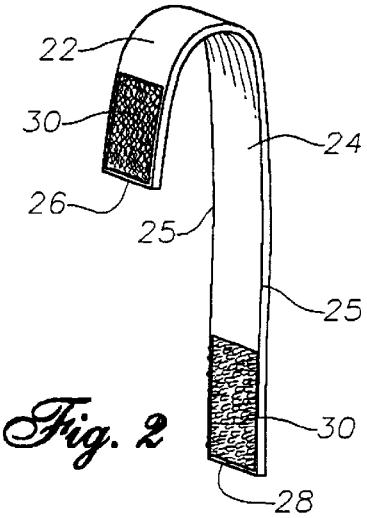
FIG. 2 is a perspective view of a belt loop in the opened state with attachment means on each end.
Figure 3:
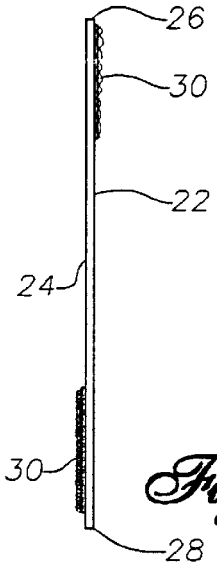
FIG. 3 is a side view of the open belt loop of FIG. 2.
Figure 4:
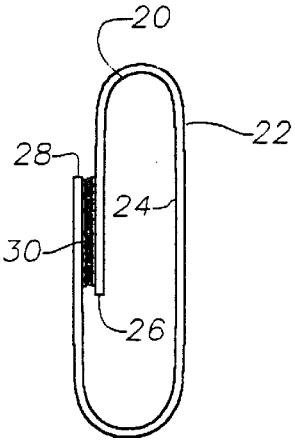
FIG. 4 is a side view of the belt loop of FIGS. 2–3 in the closed position.
Figure 5:
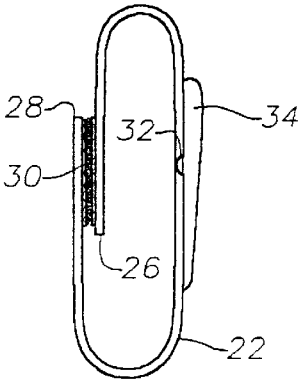
FIG. 5 is a side view of the belt loop in the closed position where the belt loop includes a display member.
Figure 6:
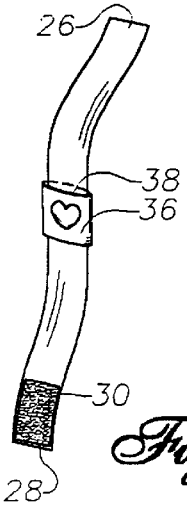
FIG 6 is a side view of the unsecured removable belt loop that includes a removable display member.

Each side of the strip 22, 24 may be made of different materials or a combination of different materials. Also, each strip may have different designs on each side 22, 24 so that the strip can be reversible and each side of the strip can be displayed. As shown in FIGS. 2, 3, and 4, which show a specific embodiment, the device can include an elongated flexible strip with an inner surface 24 and an outer surface 22. As used herein, the term "inner surface" refers to the portion of the strip forming the inside of the loop when the loop is formed, and the term "outer surface" refers to the portion of the strip forming the outside of the loop when the loop is formed. As shown in FIGS. 2–5, the fastening means can be disposed on opposite ends, e.g., a first end 26 and second end 28, of the flexible strip. In the preferred embodiment, the strip is flat. However, the strip can be made of an elongated piece of material that is tubular or even irregularly shaped, e.g., having an oval cross-section. The sides of the strip 25 may be straight as shown in FIG. 2., but can also have shaped or scalloped sides (not shown). In FIGS. 2–6 the preferred fastening means 30 are corresponding sections of miniature sets of hooks and eyes that are also commonly known as Velcro™; a type of fastening means will also be known as "connecting" or "attaching strips." These connecting strips 30 are sewn or otherwise permanently attached to the flexible strips near the first and second ends 26 and 28 of the flexible strips so that the first and second ends can be disposed in contact with each other and overlapped as needed to provide for an ideal size belt loop. In FIG. 4, the flexible loop is in the closed position, and the inner side of the flexible strip 24 located near the second end 28 is looped around onto the outer side of the flexible strip 22 near the first end 26 so that the fastening means situated at the first end 26 and the second end 28 are overlapped as needed to provide the ideal size of the closed loop 20. In this regard, an advantageous aspect of a specific embodiment of the invention, shown in FIGS. 2–6, is that because of the length of the connecting strips 30, the diameter of the loop can be adjusted, depending on the width of the belt around which it is being placed. The extent of overlap between the attachment strips 30 determine the diameter of the resulting loop.

The strips of Velcro™ may be used as the only attaching means or may be used in conjunction with conventional snaps and standard size hooks and eyes that are widely used to close garments (not shown). Other attachment means can also be used. For example, metal or plastic snaps sets can be positioned along the inner surface and outer surface near the first and second ends to ensure that the flexible strip will be adjustable and can form a loop on a belt of any width. Also, standard-sized sets of metal or plastic hooks and eyes that are routinely used on garments can also be positioned along the inner surface and outer surface near the first and second ends so that the hooks and eyes are disposed in contact with each other and the ends of the flexible strip are overlapped as needed to provide for an ideal size belt loop.

Additionally, other types of fastening means can also attach the first and second ends of the flexible strip in such a manner that also allows adjustment of the flexible strip so it can be used on commercially available belts of any width. For example, a rigid circular or oblong loop-like member that is permanently attached to the flexible strip on the first end of the strip along with a rigid hook-like member on the second end of the flexible strip that hooks into the loop-like member can be used (not shown). In that case, a metal bar is attached to the end of the flexible strip and then threaded through the rigid loop-like member so that the excess material of the flexible strip can be slid inward to overlap a portion of the flexible strip until the length of flexible strip of material is ideal for the size of the loop. Such a metal bar is often used with items such as neck ties and pet collars. Another fastening means or fastener includes rigid plastic members which can be securably interlocked and have means for receiving the first and second ends; these plastic members may also include means for adjusting the length of the flexible strip (not shown). Such plastic members are often used with other products that are commercially marketed including back packs.

An important component of a preferred embodiment of this invention includes a display member. That is, a display member 34, 36, 40, 48 is added to the flexible strip in FIGS. 5–10. The display member can come in a variety of forms and shapes, and is preferably both functional and ornamental and may render support to the belt loop. The display member itself may be irregular in shape and should be ornamental because of its shape, such as the heart 48 shown in FIG. 8. Also, the display member itself may be ornamental because it is made of or includes decorative materials and items. For example, the display member 40 in FIG. 7 may have a circular faux pearl surrounded with rhinestones that are integral and securably attached to the display member. Alternatively, the display member may be designed so that different ornaments can be removably attached to the display member itself.

Additionally, the display member may be integral; that is, the display member may be permanently attached to the flexible belt loop or otherwise designed so that the display member cannot be removed from the flexible strip. The integral display member which is permanently attached to the flexible strip can be sewn, glued, or otherwise designed so it is securably attached. Conversely, the display member may be removable. When the belt loop has a display member that is easily removable, i.e., not permanently affixed to the flexible strip, a variety of display members can be used in conjunction with a flexible strip to form the invention. In a preferred embodiment depicted in FIG. 5, a front display member 34 is securably attached to the front side of the flexible strip 22, i.e., the outer surface, through a type of fastening means 32 such as a snap or Velcro ™. Thus, the flexible main strip can have attachment strips on opposite sides and ends, so that a loop can be formed, and can also have an attachment strip proximate to the middle of the outer surface of the main strip, so that the display member can be removably attached to the main strip via the middle attachment strip. The corresponding means of attachment is located on the back side of the display member and on the outer surface of the belt loop. The display members may be made of a variety of materials that are flexible, semi-flexible, or even rigid. For example, the display member 34 in FIG. 5 may be made of fabric, leather, plastic, or metal.

Also, the display member can be attached to the flexible strip in a number of different ways. For example, a display member may slide onto, clip, snap, pierce, or otherwise be attached to the flexible strip. In a specific embodiment depicted in FIG. 6, the display member 36 encircles the flexible strip and has a sleeve-like form 38. This display member is slideable, does not attach to the flexible strip, and can be slid on and off the flexible strip 25 and added or removed as desired. Moreover, a plurality of display members can be placed on or attached to the main strip (not shown).

In another specific embodiment, the display member, which is not shown in the illustration, has a display member with a sharp pin that pierces the flexible strip and interlocks with a post or other member, much like a conventional tie tack.

Figure 7:
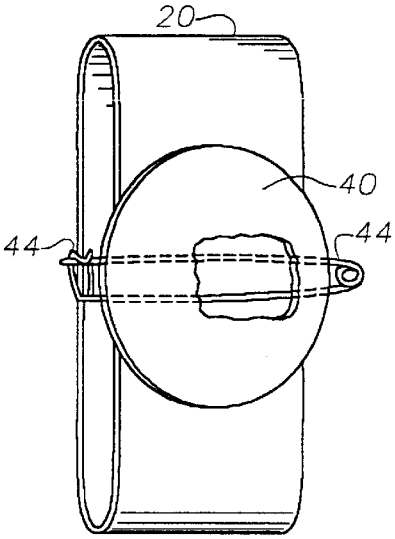
FIG. 7 is a front view of a belt loop in the closed position having a display member which is attached via a clasp-like closure means.

In another specific embodiment, shown in FIG. 7, a front display member 40 is securably attached to a fastenable clasp 44. The clip 44 which is attached to the display member 40 envelopes and is closed around the flexible strip or closed loop 20. This type of display member is not integral with the belt loop and enables the display member to be added or removed as desired.

Figure 8:
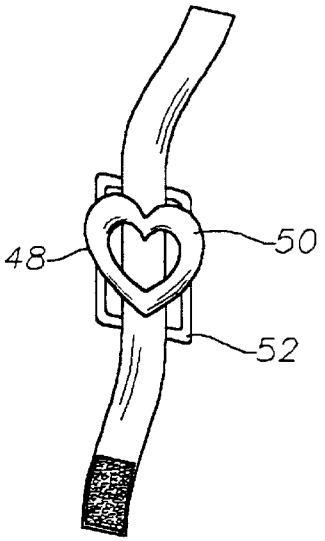
FIG. 8 is a front view of an additional embodiment in the opened state with a display member which has front, back, and side support means for receiving and enveloping the flexible strip.
Figure 9:
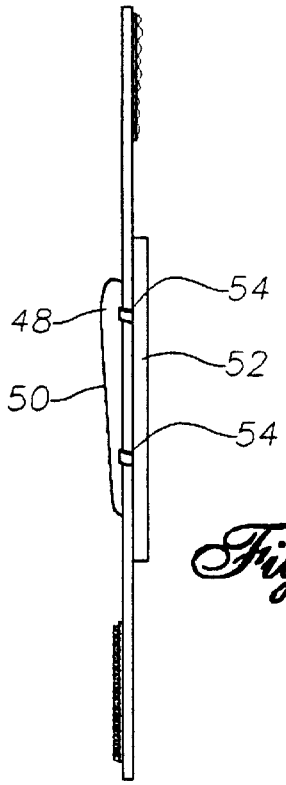
FIG. 9 is a side view of the embodiment in FIG. 8 showing a display member with front, side, and back support means.

In yet another specific embodiment, as shown in FIGS. 8 and 9, a display member 48 having a front support member 48, a back support member 52, and side support member 54 is designed to slide onto and receive the flexible strip. This display member can also be added or removed to the flexible strip to suit the user's preference. As used herein, a "front support member" refers to the portion of the display member that lays or rests on the front side of the flexible belt loop. The "back support member" is defined herein as the portion of the display member that lays or rests on the back side of the flexible belt loop. The "side" member is the structure which attaches the front support member to the back support member.

Figure 10:
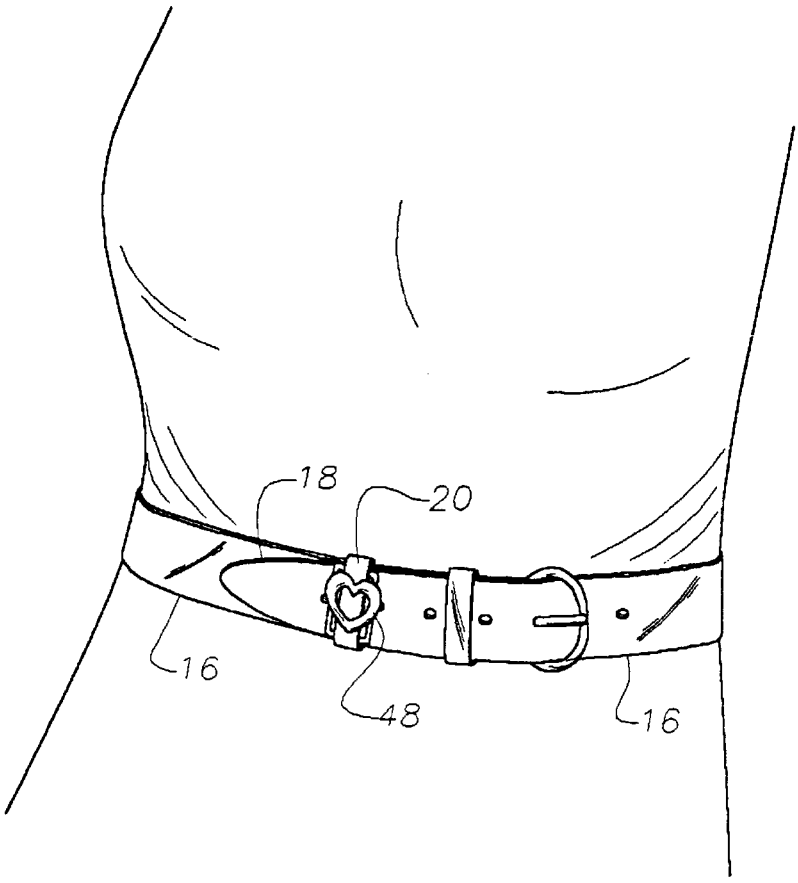
FIG. 10 is a front view of a torso of a person wearing a garment belt with the embodiment in FIGS. 8–9 in the closed position.

As shown by reference to FIG. 10, the adjustable, removable belt loop 20 with a display member 50 can be wrapped around the loose belt end 18 and secured behind the main portion of the belt 16. This device enables the user to position the device 20 to keep the free end 18 of the belt from hanging loosely downward or projecting outwardly from the main portion of the belt 16.

What is claimed is:

1. A garment belt, comprising:

a main portion;

an easily removable adjustable belt loop comprising:

an elongated main flexible strip having an inner surface with a connecting portion, an outer surface with a connecting portion, a first end and a second end;

means for removably attaching the first end to the second end to form a loop around the main portion of the belt and the free end of the belt wherein the connecting portion of the outer surface and the connecting portion of the inner surface of the flexible strip are disposed in removable contact with each other to accomplish the attachment and to form the belt loop; and a removeable and interchangeable display member having an inner supporting member, an other supporting member, and a pair of side members connecting the inners and others supporting member wherin the elongated main flexible strip is disposes between the inner and other supporting members.

2. The garment belt of claim 1 wherein the display of a ridig material.

3. The garment belt of claim 1 wherein the display member is made of flexible material.

4. The garment belt of claim 1 wherein the side member are made of a flexiable material.

5. The garment belt of claim 1 wherein the display member is tubular and the inner and outer supporting members and the side members are made of flexible material.

6. The garment belt of claim 1 wherein the means for removably attaching he first end to the second end to form a loop comprises a series of corresponding snaps.

7. The garment belt of claim 1 wherein the means for removably attaching the first end to the second end to form a loop comprises a series of corresponding hook and loop fasters.

8. The garment belt of claim 1 wherein the outer and inner surface are reversible and have portions which attach on both sides of the inner surface.

9. The garment belt of claim 1 wherein the display member includes a fastenable clasp comprising a clip which includes the inner and outer supporting members and the air of side members, and wherein the clip envelopes and is closed around the elongated strip.

10. The garment belt of claim 1 wherein the display member is tubular and slides onto the flexible strip.

11. The garment belt of claim 1 wherein the pair of side members of the display member connects the inner and the outer supporting member by display by puncturing the elongated flexible strip, thereby removably attaching the display member to the elongated flexible strip.

* * * * *